US009988903B2

(12) United States Patent
Sollami

(10) Patent No.: US 9,988,903 B2
(45) **Date of Patent: *Jun. 5, 2018**

(54) COMBINATION POLYCRYSTALLINE DIAMOND BIT AND BIT HOLDER

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/719,638

(22) Filed: May 22, 2015

(65) Prior Publication Data

US 2015/0315910 A1 Nov. 5, 2015

Related U.S. Application Data

(63) Continuation-in-part of application No. 13/801,012, filed on Mar. 13, 2013, now Pat. No. 9,039,099.

(60) Provisional application No. 61/716,243, filed on Oct. 19, 2012.

(51) Int. Cl.

| | |
|---|---|
| ***E21C 35/18*** | (2006.01) |
| ***E21C 35/183*** | (2006.01) |
| ***B28D 1/18*** | (2006.01) |
| ***E21C 35/19*** | (2006.01) |
| ***E21C 35/197*** | (2006.01) |

(52) U.S. Cl.

CPC ..... *E21C 35/183* (2013.01); *B28D 1/188* (2013.01); *E21C 35/19* (2013.01); *E21C 35/197* (2013.01); *E21C 2035/1803* (2013.01); *E21C 2035/1816* (2013.01); *E21C 2035/191* (2013.01)

(58) Field of Classification Search

CPC ... E21C 35/19; E21C 35/191; E21C 2035/191

See application file for complete search history.

(56) References Cited

U.S. PATENT DOCUMENTS

| | | | | |
|---|---|---|---|---|
| 3,397,012 | A | 8/1968 | Krekeler | |
| 3,519,309 | A | 7/1970 | Engle | |
| 3,865,437 | A | 2/1975 | Crosby | |
| 4,084,856 | A * | 4/1978 | Emmerich | E21C 35/197 175/354 |
| 4,247,150 | A | 1/1981 | Wrulich et al. | |
| 4,310,939 | A | 1/1982 | Iijima | |
| 4,453,775 | A * | 6/1984 | Clemmow | E21B 10/38 175/393 |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — John J Kreck

(74) *Attorney, Agent, or Firm* — Mercedes V. O'Connor; James N. Videbeck; Rockman Videbeck & O'Connor

(57) ABSTRACT

A quick change type bit/bit holder includes several different structures for holding the item in a bit block without the necessity of a fastener. The bit portion of the bit/bit holder combination includes a ductile steel insert with a polycrystalline diamond coated tungsten carbide bit positioned therein. The ductility of the steel insert acts as a shock absorber to allow the bit to successfully remove concrete as well as asphalt in a road milling machine.

14 Claims, 4 Drawing Sheets

(56) References Cited

U.S. PATENT DOCUMENTS 4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,694,918 A 9/1987 Hall
4,763,956 A 8/1988 Emmerich
4,811,801 A 3/1989 Salesky
4,818,027 A 4/1989 Simon
4,844,550 A 7/1989 Beebe
4,915,455 A 4/1990 O'Neill
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,492,188 A 2/1996 Smith et al.
5,607,206 A 3/1997 Siddle
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,250,535 B1 * 6/2001 Sollami ..... B23K 1/0008 228/125
6,331,035 B1 12/2001 Montgomery, Jr.
6,357,832 B1 3/2002 Sollami
6,371,567 B1 4/2002 Sollami
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 * 5/2004 Sollami ..... B28D 1/188 125/36
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 * 9/2009 Hall ..... E21C 35/183 299/111
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 * 6/2012 Hall ..... E21C 35/183 299/102
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 * 5/2015 Sollami ..... E21C 35/183 299/79.1
9,316,061 B2 4/2016 Hall
2002/0074850 A1 6/2002 Montgomery
2002/0074851 A1 6/2002 Montgomery
2002/0167216 A1 11/2002 Sollami
2003/0015907 A1 1/2003 Sollami
2003/0047985 A1 3/2003 Stiffer
2004/0004389 A1 1/2004 Latham
2004/0174065 A1 9/2004 Sollami
2006/0071538 A1 4/2006 Sollami
2006/0186724 A1 8/2006 Stehney
2008/0035386 A1 2/2008 Hall et al.
2009/0261646 A1 10/2009 Ritchie et al.

(56) References Cited

U.S. PATENT DOCUMENTS

| | | | | |
|---|---|---|---|---|
| 2010/0244545 | A1 | 9/2010 | Hall | |
| 2010/0253130 | A1 | 10/2010 | Sollami | |
| 2010/0320829 | A1* | 12/2010 | Sollami | E21C 35/18 299/106 |
| 2011/0006588 | A1 | 1/2011 | Monyak et al. | |
| 2011/0089747 | A1 | 4/2011 | Helsel | |
| 2011/0204703 | A1 | 8/2011 | Sollami | |
| 2011/0254350 | A1 | 10/2011 | Hall | |
| 2012/0027514 | A1 | 2/2012 | Hall | |
| 2012/0038203 | A1 | 2/2012 | Hall | |
| 2012/0068527 | A1 | 3/2012 | Erdmann | |
| 2012/0181845 | A1 | 7/2012 | Sollami | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2014/0326516 | A1 | 11/2014 | Haugvaldstad | |
| 2015/0028656 | A1 | 1/2015 | Sollami | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0194956 | A1 | 7/2016 | Sollami | |
| 2017/0089198 | A1 | 3/2017 | Sollami | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| GB | 2483157 | 2/2012 |
| WO | 2008105915 A2 | 9/2008 |
| WO | 2008105915 A3 | 9/2008 |
| WO | 2009006612 | 1/2009 |

* cited by examiner

COMBINATION POLYCRYSTALLINE DIAMOND BIT AND BIT HOLDER

This application claims priority to and is a continuation-in-part of provisional patent application Ser. No. 61/716,243 filed Oct. 19, 2012, and claims priority to and is a continuation in part of non-provisional application Ser. No. 13/801,012 filed Mar. 13, 2013 to the extent allowed by law.

This invention relates generally to an integrally formed road milling bit and bit holders for mounting on road milling and other machines and, more particularly, to combinations of bit and bit holders having a polycrystalline diamond cutting tools as a forward leading tip of each.

BACKGROUND OF THE INVENTION

Originally, road milling equipment was utilized to smooth out bumps in the surface of a roadway or grind down the joinder of two adjacent concrete slabs that may have buckled. However, later these road milling machines, operated with a cylindrical drum having a plurality of bit blocks mounted thereon in herringbone or spiral fashion, and bit holders with bits on top thereof in turn mounted on the bit blocks, have been utilized for completely degrading concrete and macadam roads down to their gravel base. The apparatus can also be used for trenching and mining operations.

Bits such as those shown in U.S. Pat. No. 6,739,327 disclose an insert having a conical cutting tip that is mounted in a recess in a frustoconical forward portion of the bit. The insert 88 is surrounded by a hardened annular collar that provides added wear resistance to the cutting tool. The tool has a solid generally cylindrical shank extending axially rearwardly from the body portion.

The bit as described in the U.S. Pat. No. 6,739,327 patent fits in a central bore in a bit holder as described in U.S. Pat. Nos. 6,371,567 and 6,585,326. The above-described bit holders, being frictionally seated in bores in their respective bit blocks mounted on drums, and not held therein by retaining clips or threaded nuts provide for ease of removal and replacement when the bit holders are worn through use, or broken because of the harsh road degrading environment they are used in.

Additionally, it has been found that because of the harsh use environment, individual bits may wear or be broken off of their shanks and need replacement. Historically, these bits and bit holders have been made of steel with hardened tungsten carbide tips or collars to lengthen their end use service time.

Recently, the use of materials harder than tungsten carbide, i.e., polycrystalline diamond, such as shown in U.S. Pat. No. 8,118,371 has been used in certain road milling operations, notably the degradation of asphalt layers on long roadway stretches. While the hardness of the polycrystalline diamond tip lengthens the useful life of the combined bit and bit holder shown in the '371 patent, such that the bit does not have to be removable from the bit holder, the combination includes a somewhat brittle polycrystalline diamond tip that is not suitable for use in degrading concrete highways, or curved highway stretches such as cloverleafs and the like.

A need has developed for the provision of a polycrystalline diamond structured combination bit and bit holder that is sturdy enough to withstand the forces found when degrading or breaking up the surfaces of not only macadam (asphalt) roadways but also concrete roadways.

SUMMARY OF THE INVENTION

The invention resides a bit holder for road milling machinery, a shank comprising an elongate generally hollow cylindrical member having a distal end including an elongate axially inwardly extending slot through an annular outer side wall thereof and a leading diamond coating or layered tip thereon.

BRIEF DESCRIPTION OF THE DRAWINGS

The features of the present invention which are believed to be novel are set forth with particularity in the appended claims. The invention may best be understood from the following detailed description of a currently preferred embodiment and modifications thereof taken in conjunction with the accompanying drawings wherein like numerals refer to like parts, and in which:

DETAILED DESCRIPTION OF THE PREFERRED EMBODIMENT

Figure 1:
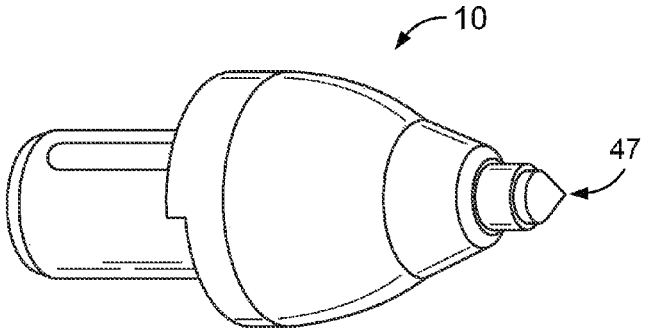
FIG. 1 is a front ¼ perspective view of a first embodiment combination bit and bit holder including a conical polycrystalline diamond tip thereof constructed in accordance with the present invention.
Figure 2:
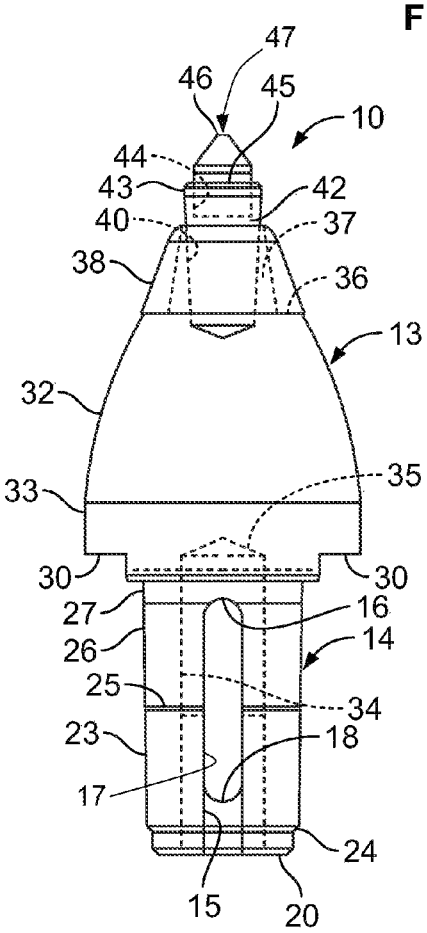
FIG. 2 is a front elevational view of the combination bit and bit holder shown in FIG. 1.
Figure 3:
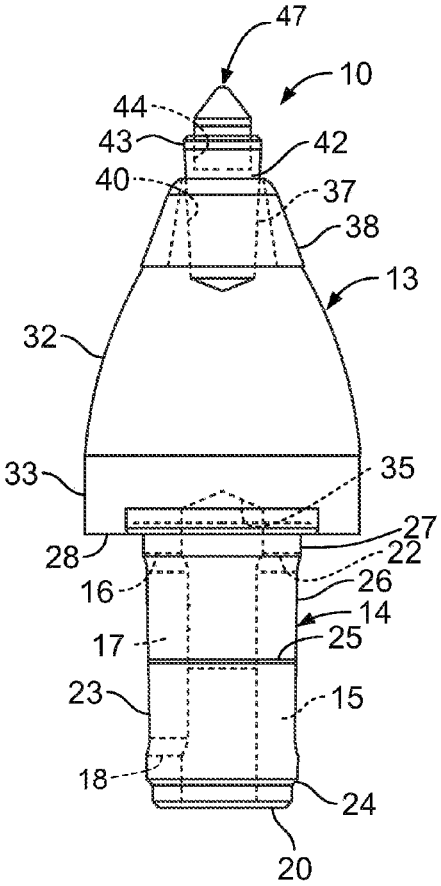
FIG. 3 is a side elevational view of the combination bit and bit holder shown in FIG. 1.
Figure 4:
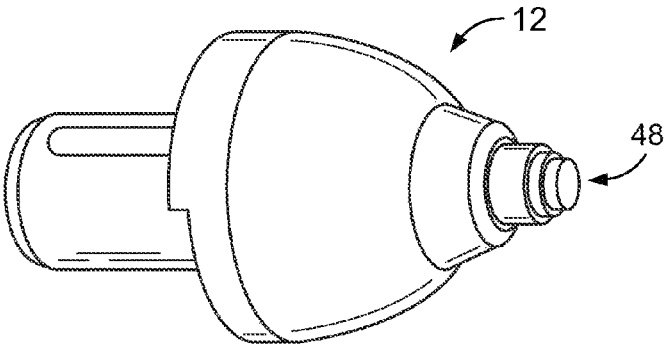
FIG. 4 is a front ¼ elevational perspective view of a modification of the first embodiment of a combination bit and bit holder showing a flat top cylindrical polycrystalline diamond tip and constructed in accordance with the present invention.

Referring to FIGS. 1-6, a first embodiment of a bit holder 10 and a first modification of a bit holder 12 of the present invention are shown in perspective view in FIGS. 1 and 4, respectively. The invention resides in a unitary bit and bit holder construction that includes a bit holder body 13, generally constructed in accordance with the teachings of U.S. Pat. No. 6,585,326, and a generally cylindrical hollow shank 14 which in this embodiment of one side thereof has an elongate first slot 15 extending from a generally annular distal end 20 of the shank 14 axially upward or forward to an upper termination 16 adjacent the upper or forward end of the shank 14. In this embodiment, the shank 14 also includes a internally oriented second slot 17 180 degrees around the annular shank 14 from the first slot 15. This second slot 17, first disclosed in U.S. Pat. No. 6,685,273, is parallel to the first slot 15 and is an internal slot having a rearward semicircular termination 18 inwardly adjacent the distal end 20 of the shank 14 and a forward semicircular termination 22 generally coinciding longitudinally and axially with the upper termination 16 of the first slot 15.

In this first embodiment, the shank 14 preferably includes a lower or first tapered portion 23 running axially from a stepped shoulder 24 adjacent the distal end 20 of the shank 14 upwardly or axially from the top or front of the shank 14 where it terminates generally mid slot longitudinally, and includes an annular shoulder 25 separating this lower tapered portion 23 from an upper or second tapered portion 26 which extends from that shoulder 25 generally to the top of the shank 14 or forward terminations of the slots. From a position adjacent the top or upper termination of the slots, a generally cylindrical upper portion 27 of the shank 14 extends towards a generally annular back flange 28 denoting the base of the bit holder body 13 of the bit holder 10.

In the preferred first embodiment of bit holder 10, this generally annular flange 28 includes a pair of horizontal slots 30-30 generally perpendicular to the longitudinal axis of the combination bit/bit holder, one on either side of the generally annular flange 28 into which bifurcated fork tines may be inserted between the base of the body portion of the bit holder and a bit block (not shown) into which the shank of the bit/bit holder combination is inserted and retained by outward radial force in use.

An enlarged upper body 32 of the bit holder body 13 of the bit/bit holder combination 10 includes a generally cylindrical base 33, termed in the trade ad a tire portion, having a cylindrical side wall extending upwardly approximately ½ inch to a generally frustoconical, but in this embodiment a convex surfaced upper body 32, which is a solid structure.

In this first preferred embodiment, a central bore 34 longitudinally and axially through the shank 14 of the bit holder body 13 of the bit/bit holder combination 10 terminates 35 approximately at the upper end of the shank 14. This allows the generally C-shaped annular side wall of the shank 14 to radially contract when the shank 14 is mounted in one of a tapered or cylindrical bore in a bit block (not shown).

In this first preferred embodiment, the bit holder body 13 of the bit/bit holder combination 10 provides added bulk and strength to the entire unitary assembly which allows the bit/bit holder combination 10 of the present invention to withstand substantial forces and stress superior to heretofore known bit holders or bit/bit holder combinations. The present invention may be utilized not only in the degrading and removal of macadam or asphalt from long straight stretches of roadway, but may also provide for the removal of concrete and other materials both in straight long stretches and in curved sections such as at corners, cloverleaf intersections, or the like. Also the flat top design is less expensive to make and is a readily available part stocked by many suppliers. Such commercially available products are the subject matter of U.S. Pat. Nos. 5,355,969 and 8,169,634, the contents of which are incorporated herein by reference.

Adjacent the top of the preferred first embodiment of the present invention shown in FIGS. 1-6, the generally convex sided bit holder body 13 has a generally flat annular top surface 36 therearound positioned perpendicular to the axis of the bit holder from the interior of which axially extends a smaller radially oriented annular tapered upper or forward extension 37. Around this tapered upper extension 37 is fitted an annular tungsten carbide ring 38 which may preferably be braised into unitary construction with the remainder of the bit holder. The top or forwardmost portion of the tungsten carbide ring 38 and the annular tapered upper extension 37 of the upper body portion terminate generally at the top of the bit holder body 13 of the combination bit/bit holder 10.

With the bit holder body 13 of the present invention preferably made of 4340 or equivalent steel, the top of the upper extension 37 of the upper body 32 includes a generally cylindrical or radially declining tapered bore 40 extending from the co-terminal upper wall of the body axially inwardly thereof which defines in this preferred embodiment a declining radial taper. This tapered bore 40 extends a short distance longitudinally axially inwardly of the annular extension 37 that defines the base for the tungsten carbide protective ring 38. Bore 40 can also be a hollow cylindrical shape or one having a slight draw or draft angle.

This generally cylindrical or declining taper bore 40 provides a space for receiving a complementary shaped positive generally cylindrical or declining tapered outer surface of a solid base insert 42 for the bit/bit holder combination. The base insert 42 for the bit also extends upwardly and if tapered outwardly axially longitudinally from the co-terminal upper extension 37 of the bit holder body 13 and includes an upper annular ring portion 43 which, in this embodiment, is made of tungsten carbide.

This top portion of the bit base insert 42 includes a generally cylindrical bore 44 positioned centrally therein into which tip base 45 of the bit tip may be positioned and braised therein to provide a unitary structure. This tip base 45 may be made of steel or tungsten carbide and includes at the outer or upper end thereof a tip 46 which is preferably made of polycrystalline diamond structure which, in this embodiment, may be frustoconical in shape 47, as shown in FIGS. 1-3, or a flat generally cylindrical puck shape 48 as shown in the first modification in FIGS. 4-6. The upper end of the bit tip 46 may also be made of an industrial diamond material and may be a coating or outer layer of such natural diamond or polycrystalline diamond (PCD) material. The coating or layer may be formed of a high pressure, high temperature process.

The conical tip 46 shown in FIGS. 1-3 is of the type which preferably has been used in degrading straight long stretches of asphalt or macadam, and which is sufficiently brittle not to be used in more strenuous applications such as degrading concrete and degrading curved sections of highway surface construction. The present unitary bit/bit holder of the invention overcomes such limitations.

Figure 5:
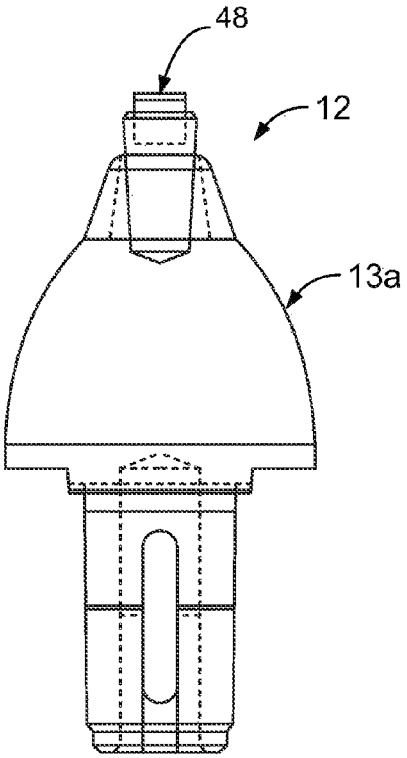
FIG. 5 is a front elevational view of the modification of the first embodiment of the combination bit and bit holder shown in FIG. 4.
Figure 6:
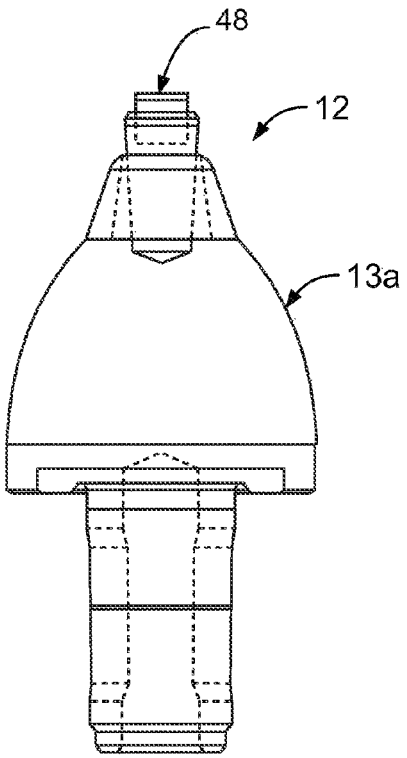
FIG. 6 is a side elevational view of the modification of the first embodiment of the combination bit and bit holder shown in FIG. 4.
Figure 7A:
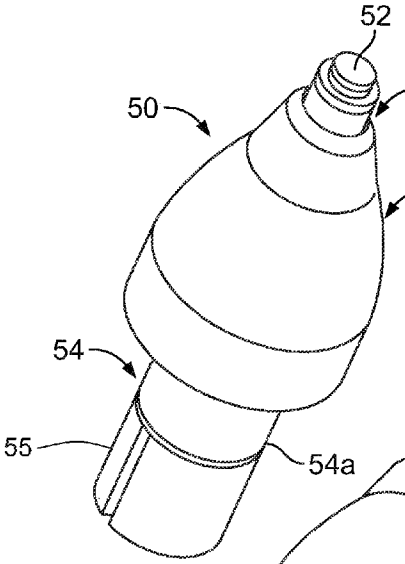
FIG. 7*a* is a ¾ top perspective view of a second embodiment of the combination bit and bit holder constructed in accordance with the present invention showing a trepanned shank distal end having 3 longitudinal spaced slots therein.
Figure 7B:
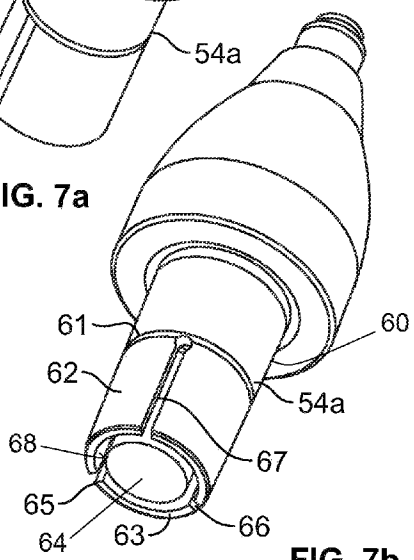
FIG. 7*b* is a ¾ bottom perspective view of the second embodiment of the present invention showing the longitudinally slotted trepanned shank thereon.
Figure 8A:
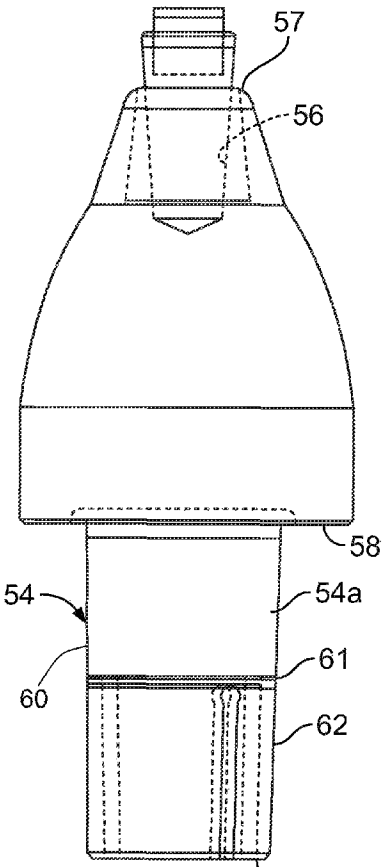
FIG. 8*a* is a side elevational view of the second embodiment of the present invention shown in FIGS. 7*a* and 7*b;*
Figure 8B:
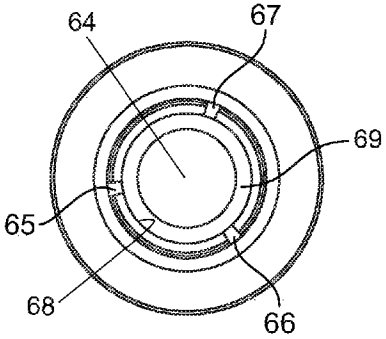
FIG. 8*b* is a bottom plan view of the second embodiment shown in FIG. 8.

The flat generally cylindrical puck shaped tip 48 of the bit of the first modification of the bit holder 12 shown in FIGS. 4-6 provides a substantially stronger tip that is able to withstand the added forces and peak jolts found in degrading concrete and the like, and together with the added bulk of the bit holder body 13 of the preferred bit/bit holder combination is capable of removing or degrading concrete surfaces with the added life expectancy shown in prior bit/bit holder constructions with PCD tips that have heretofore been utilized only in removing long straight stretches of macadam. The steel member 41 holding the puck is an impact absorbing member that can stretch and compress without fracturing. A road milling machine can travel faster with forward speed using the instant bit/bit holders than it can with bit holders having a strictly tungsten carbide forward end. The remainder of the first modification is identical to the first embodiment.

A second embodiment of a bit holder 50 of the preferred invention, shown in FIGS. 7*a*, 7*b*, 8*a* and 8*b*, includes a bit 51, tip 52 and bit holder body 53 that is similar to that shown in FIGS. 4-6. A shank 54 of the bit/bit holder combination 50 provides an important aspect of the present invention. In the second embodiment of bit holder 50, the outer surface of a side wall 54*a* of the shank 54 is substantially similar to that shown in FIGS. 1-6, with the exception that a distal first tapered portion 62 of the shank 54 includes three evenly spaced slots 65, 66, 67 longitudinally formed axially through the side wall 54*a*. It should be noted that the first tapered portion 62 may be constructed with either a slight taper of one degree or less or down to a cylindrical (no-taper) configuration. The second embodiment may include more or fewer slots.

In this second embodiment, not only is the generally frustoconical, convex side wall of the bit holder body 53 solid in construction, with the exception of a bore 56 for mounting the bit 51 at a forward end 57 thereof, the shank 54 that extends from a generally annular flange 58 of the bit holder body 53 is also largely solid in construction. Similar to the first embodiment of bit holder 10, the upper or forward portion of the shank 54, adjacent the generally annular flange 58 of the body portion, includes a cylindrical portion which has a second tapered portion 60 extending axially from the border thereof and a shoulder portion 61 that extends radially outwardly of the base of the second tapered portion 60 that defines the top of the first tapered portion 62 which extends axially to a distal end 63 of the shank 54.

As indicated previously, this first tapered portion 62 may include a taper of about 1 degree or less, down to having a cylindrical outer surface. Whereas the shank in the first embodiment shown in FIGS. 1-6 was hollow at its center, the shank 54 of the second embodiment is solid at its center core 64 completely from the bit holder body 53 to a distal end 63 of the shank 54. The first tapered portion 62, which in this embodiment includes three equally spatially circumferentially related longitudinal slots 65, 66, 67, defines a generally annular ring with the exception of the equally spaced slots 65, 66, 67. This slightly radially inwardly deformable first tapered portion 62 has an inner annular surface 68 defined by a trepanned or hole saw type groove 69 extending inwardly of the shank 54 from the distal end 63 to the top of the first tapered portion 62. The depth of the trepanned groove 69 may by varied to obtain the proper preformability of the sidewall and the number of slots may be varied depending on the design parameters desired.

This annular trepanned groove 69 is formed to provide a side wall for the first tapered portion 62 having a thickness which may vary from about ⅛ inch to about ½ inch depending upon the desired elastic flexibility of the side wall of the first tapered portion 62.

In construction, the trepanned groove 69 is a less expensive forming operation than is the bore 34 found in the first embodiment of bit holder 10 of FIGS. 1-6, although the center portion of the shank may be removed if desired. Additionally, the trepanned groove 69 leaves the center core 64 of the shank 54 intact in the preferred second embodiment to provide a stronger overall construction for the combination bit/bit holder 50. Further, with the additional mass of the bit holder portion of the bit/bit holder combination, the entire bit holder may be made of less expensive steel than is necessary for the first embodiment of bit holder 10 shown in FIGS. 1-6. Generally, steels of the type 4140 may be utilized for construction of the second embodiment of the present invention.

Figure 9A:
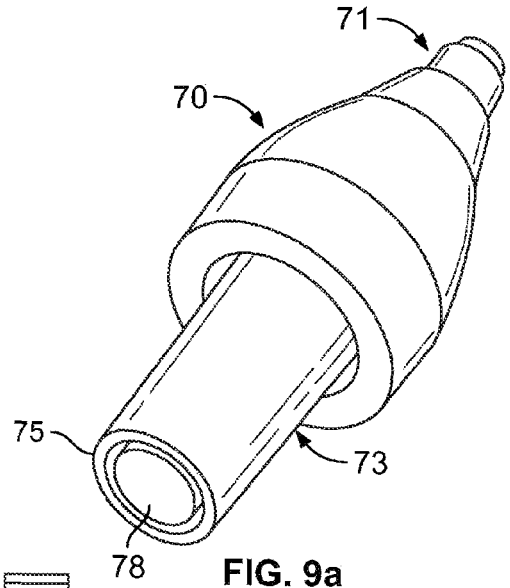
FIG. 9*a* is a bottom ¾ perspective view of a third embodiment of the present invention showing a trepanned shank constructed in accordance with the present invention.
Figure 9B:
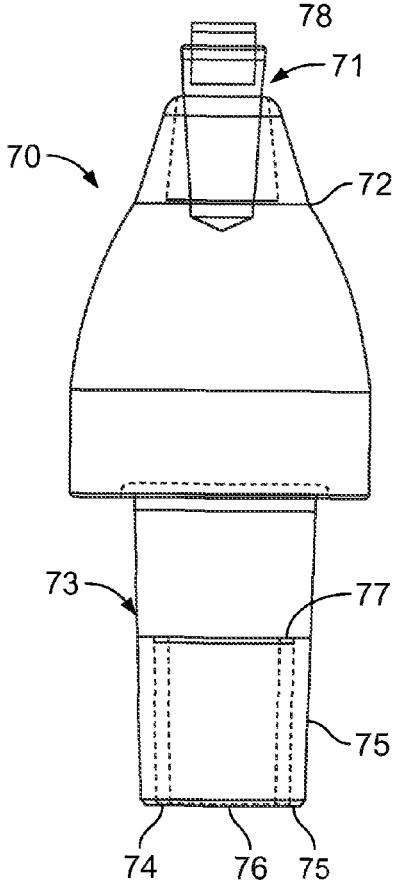
FIG. 9*b* is a side elevational view of the third embodiment of the present invention shown in FIG. 9*a;*

FIGS. 9*a* and 9*b* show the third embodiment of bit holder 70 of the present invention which has a combined bit 71 and an upper body 72 of the holder portion being identical to that shown in FIGS. 7*a*, 7*b*, 8*a* and 8*b*. The difference between the third embodiment of bit holder 70 and the second embodiment of bit holder 50 is in the trepanned first tapered portion of the shank 73, and slots shown in the second embodiment. Similar to the second embodiment of bit holder 50, the third embodiment of bit holder 70 includes an annular trepanned groove 74 that extends axially inwardly in a first tapered portion 75 of the shank 73 from a distal end 76 of the shank 73 generally to the shoulder at a top 77 of the first tapered portion 75.

The difference between the second embodiment and the third embodiment is that the third embodiment does not include the slots shown in the second embodiment. The thickness of the outer side wall of the annular first tapered portion 75 (which may also be cylindrical) will be thinner than that disclosed in the second embodiment of bit holder 50 shown in FIGS. 7*a*, 7*b*, 8*a* and 8*b* and may be on the order of 1/16 to ¼ inch wall thickness for the embodiment shown in FIGS. 9*a* and 9*b*, having a nominal 1½ inch outer diameter. As a result, while the typical interference fit for severe or extreme uses such as concrete degradation might have a solid shank interference of 0.001 to 0.003 of an inch thickness for the nominal 1½ inch diameter shank, the interference fit for the thin side wall in the trepanned first tapered portion 75 of the shank in the third embodiment of bit holder 70 would approximate two to four times the previously mentioned interference fit.

With such a fit, the shank side wall may wrinkle when a shank is inserted in a bit block bore. Again, the third embodiment of bit holder 70 shown in FIGS. 9*a* and 9*b* would be less expensive to manufacture than even the second embodiment of bit holder 50 shown in FIGS. 7*a*, 7*b*, 8*a* and 8*b*. In this third embodiment of bit holder 70, the core or central portion 78 of the shank may be left intact, or removed, and the combination of that mass in the shank together with the solid upper body and integrally formed bit 71 braised thereon provides a structure which can be utilized to degrade not only macadam or asphalt but also concrete pavement.

The use of the flat puck shaped polycrystalline bit tip, the bit/bit holder combination provides added use life for the structure and sturdiness thereof which would be superior to the bit and bit holder combinations heretofore known. The shorter use life for a tungsten carbide tipped bit has resulted in a design necessity of allowing the bit to be removed and replaced numerous times prior to replacing the bit holder.

Figure 10:
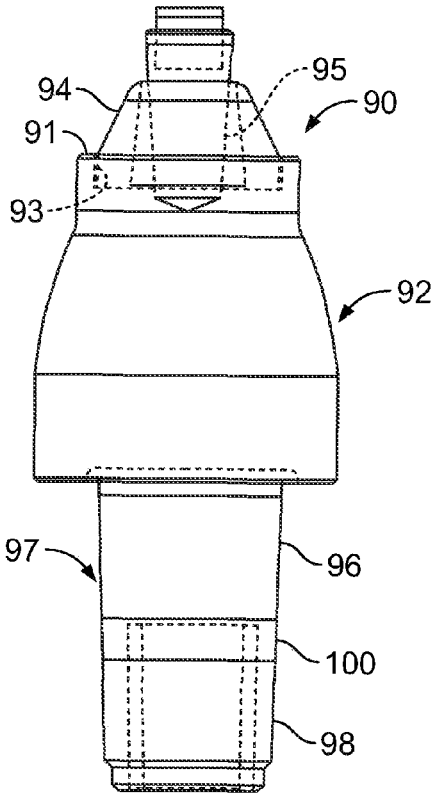
FIG. 10 is a side elevational view of a fourth embodiment of the present invention.

Referring to FIG. 10, a fourth embodiment of bit holder 90 of the present invention is similar to the prior embodiments disclosed herein with 2 differences. First, in order to provide superior brazing of the tungsten carbide ring to the forward end of the bit holder, a forwardly extending annular collar 91 is created on the bit holder body 92 to provide an annular trough 93 onto which the annular ring 94 is mounted. The vertical outer wall of the trough 93 will keep brazing material from flowing outwardly of the joinder between the base of the ring 94 and the annular flange on which the ring 94 is positioned. After the brazing is complete, the outer portion of the trough may be left as is, or may be removed and generally conformed to a shape similar to that shown in FIGS. 1-6.

The second difference between the fourth embodiment of bit holder 90 and the preceding embodiments is an annular cylindrical outer wall portion 96 adjacent the top of the first tapered portion 98 of the shank 97. When it has been determined that the design parameters for the outward forces at the shank first tapered portion 98 have been met utilizing less than the whole available surface area, an annular cylindrical area 100 may be formed adjacent the upper end of the first tapered portion 98 that keeps that area from contacting the bit block bore. The axial width of the cylindrical band may be varied to meet design criteria.

While the invention herein has been shown in three embodiments, and a modification of the first embodiment, it will be understood by those skilled in the art that changes and modifications may be made within the aspect of the present invention without departing from the true spirit and scope of the present invention. It is the intent of the appended claims to cover all such changes and modifications which fall within the true spirit and scope of the invention.

What is claimed:

1. A bit/bit holder for road milling, mining and trenching machinery comprising:

a body of rounded shape having an upper end diametrically smaller than a lower end thereof, said body being solid in a substantial portion thereof, a generally cylindrical shank extending from said lower end of said body, said shank includes a hollow portion substantially along its entire length and includes a termination axially adjacent said lower end of said body, and including at least one axially oriented elongate slot through a side wall of said shank, said upper end of said body including a forward extension axially extending from said upper end, the forward extension diametrically smaller than the upper end and the forward extension including a first bore extending axially therein to the upper end, an insert retained in said first bore forming a unitary structure therewith said first bore extending axially in said forward extension to said upper end of said body, the forward extension including a generally cylindrical side wall, said insert having a complementary shape side wall for matingly fitting therein, and the top of said insert including a central second cylindrical bore therein, and a diamond topped bit retained in said second central bore as a unitary structure therewith.

2. The bit/bit holder as defined in claim 1 wherein said diamond topped bit includes a PCD layer thereon.

3. The bit/bit holder as defined in claim 1 wherein said diamond topped bit includes a PCD coating thereon.

4. The bit/bit holder as defined in claim 1 wherein said diamond topped bit includes one of an industrial diamond coating and industrial diamond layer thereon.

5. The bit/bit holder as defined in claim 1 wherein said insert is made of tungsten carbide.

6. The bit/bit holder as defined in claim 1 wherein said insert is press fit in said first bore in said body.

7. The bit/bit holder as defined in claim 1 wherein said insert is brazed in said body.

8. The bit/bit holder as defined in claim 1 wherein said insert is shrink fitted in said body.

9. The bit/bit holder as defined in claim 1, wherein the shank comprises:

a first tapered portion axially extending from a stepped shoulder adjacent a distal end of the shank;

an annular shoulder axially extending from the first tapered portion;

a second portion axially extending from the annular shoulder; and a generally cylindrical expanded diameter upper portion axially extending from the second portion, the upper expanded diameter portion being subjacent the lower end of the body.

10. The bit/bit holder as defined in claim 1, wherein said first bore axially extends a predetermined distance from the forward extension toward the lower end of the body, and wherein the predetermined distance is less than a distance from the upper end to the lower end of the body.

11. The bit/bit holder as defined in claim 1, wherein the first bore comprises a slight draft angle.

12. The bit/bit holder as defined in claim 1, wherein the diamond topped bit comprises a base made of tungsten carbide.

13. The bit/bit holder as defined in claim 1 wherein said body, shank, insert and bit form a unitary structure.

14. The bit/bit holder as defined in claim 1 wherein said hollow portion of said shank defines a constant diameter and said termination thereof is of said diameter.

* * * * *